US005821202A

United States Patent [19]

Forester et al.

[11] Patent Number: 5,821,202

[45] Date of Patent: Oct. 13, 1998

[54] HYDROCARBON STREAM ANTIFOULANT METHOD USING BRIDGED ALKYL PHENATES

[75] Inventors: David R. Forester, Concord Township; Bharat B. Malik, Euclid, both of Ohio

[73] Assignee: The Lubrizol Corporation, Wickliffe, Ohio

[21] Appl. No.: 841,240

[22] Filed: Apr. 29, 1997

[51] Int. Cl.[6] ..... C09K 3/00; C10G 9/12

[52] U.S. Cl. ..... 507/90; 507/256; 507/264; 208/48 AA

[58] Field of Search ..... 507/90, 939, 264, 507/256; 208/48 AA

[56] References Cited

U.S. PATENT DOCUMENTS

| | | | |
|---|---|---|---|
| 2,760,852 | 8/1956 | Stevens et al. | 44/78 |
| 2,916,454 | 12/1959 | Bradley et al. | 507/90 |
| 3,035,908 | 5/1962 | Gottshall et al. | 44/75 |
| 3,256,183 | 6/1966 | Greenwald | 252/32.7 |
| 3,657,133 | 4/1972 | Miller | 252/76 |
| 4,775,458 | 10/1988 | Forester | 208/48 AA |
| 4,775,459 | 10/1988 | Forester | 208/48 AA |
| 4,804,456 | 2/1989 | Forester | 208/48 AA |
| 4,828,674 | 5/1989 | Forester | 208/48 AA |
| 4,927,519 | 5/1990 | Forester | 208/48 AA |
| 5,021,498 | 6/1991 | Stephenson et al. | 524/484 |
| 5,073,248 | 12/1991 | Stephenson et al. | 208/22 |
| 5,100,531 | 3/1992 | Stephenson et al. | 208/22 |
| 5,143,594 | 9/1992 | Stephenson et al. | 208/48 AA |
| 5,540,861 | 7/1996 | Grossi et al. | 208/48 AA |

*Primary Examiner*—Philip Tucker
*Attorney, Agent, or Firm*—David M. Shold

[57] ABSTRACT

Formation of fouling deposits in a hydrocarbon process stream during processing at elevated temperatures is reduced by including in the hydrocarbon process stream an antifouling amount of a salt of a hydrocarbyl-substituted linked hydroxyaromatic compound, where the linked compound comprises at least two aromatic moieties.

38 Claims, No Drawings

HYDROCARBON STREAM ANTIFOULANT METHOD USING BRIDGED ALKYL PHENATES

BACKGROUND OF THE INVFNTION

The present invention relates to a method for controlling the formation of fouling deposits in a hydrocarbon process stream during processing thereof at elevated temperatures.

Fouling of tubes and equipment carrying refinery and petrochemical process streams, particularly heated streams, is a general problem which has great impact on process economics. Certain crude oils and other feedstocks derived from crude oil, such as atmospheric pipestill residuum, catalytic cracker residuum, vacuum distillation residuum, as well as gas, oils, reformer stocks, and chlorinated hydrocarbons are of concern in this regard. Thus, whenever crude oils or other such materials are heated, especially in heat exchanger and furnace equipment, deposits including asphaltenes and coke-like materials can form. this fouling can lead to problems such as reduced run times, reduced conversions, increased energy requirements, shorter maintenance cycles, and increased feed preheat losses. Antifoulants, which minimize such problems, are therefore an important additive in many refinery processes.

Fouling can also be a problem to be avoided in refinery streams involved in processing and manufacture of alkenes such as ethylene and propylene, for instance, deethanizer bottoms. As used herein, the general term "hydrocarbon process stream" encompasses refinery process streams, petroleum process streams, and such alkene process streams, as well as other industrial process streams of a predominantly hydrocarbon nature which are subject to such fouling. The use of the term "hydrocarbon process stream" is not intended to indicate that hydrocarbons are the sole component of such stream or that hydrocarbons are necessarily the source of the fouling.

In the processing of such petroleum hydrocarbons and feed stocks, the materials are commonly heated to temperatures of 40° C. to 550° C., frequently from 200° C. to 550° C. Similarly, such petroleum hydrocarbons are frequently employed as heating media on the "hot side" of heating and heat exchange systems. In many cases, such petroleum hydrocarbons contain deposit forming compounds or constituents that are present before the processing is carried out. Examples of such preexisting deposit-forming materials are alkali and alkaline earth metal-containing compounds, e.g., sodium chloride; transition metal compounds or complexes, such as porphyrins or iron sulfide; sulfur-containing compounds, such as mercaptans; nitrogen-containing compounds such as pyrroles; carbonyl or carboxylic acid-containing compounds; polynuclear aromatic compounds, such as asphaltenes; and coke particles. These deposit-forming compounds can combine or react during elevated temperature processing to produce a separate phase known as fouling deposits, within the petroleum hydrocarbon.

It is known to reduce fouling of process streams by injecting into such streams certain anti-fouling additives, the principal components of which are often dispersants or detergents, but which may also contain minor amounts of antioxidants corrosion inhibitors, or metal deactivators or coordinators. These additives are believed to act by slowing the fouling reaction rate and dispersing any deposit-forming species present in the stream.

A variety of antifoulants are known. U.S. Pat. No. 2,760,852, Stevens et al., Aug. 28, 1956, discloses the calcium salt of the condensation product of formaldehyde and an octyl phenol in a fuel composition.

U.S. Pat. No. 5,100,531, Stephenson et al., Mar. 31, 1992, discloses the use of streams of alkyl-substituted phenol formaldehyde liquid resins in combination with hydrophilic-lipophilic vinylic polymers (e.g., acrylate fatty ester polymers) as an antifoulant for asphalt or asphaltene containing crude oil streams.

U.S. Pat. No. 5,021,498, Stephenson et al., Jun. 4, 1991, discloses an asphalt/asphaltene dispersant comprising a mixture of an alkyl substituted phenol formaldehyde liquid resin and a hydrophilic-lipophilic vinylic polymer.

U.S. Pat. No. 3,035,908, Gottshall et al., May 22, 1962, discloses an addition product of an olefin oxide and a sulfide-modified condensation product of an aliphatic aldehyde and a substituted monohydric phenol as a gasoline motor fuel additive.

U.S. Pat. No. 3,657,133, Miller, Apr. 18, 1972, discloses an oil soluble alkaline earth metal salt of a condensation product of an alkyl phenol and an aldehyde as a component in a functional fluid.

SUMMARY OF THE INVENTION

The present invention provides a method for controlling the formation of fouling deposits in a hydrocarbon process stream during processing thereof at elevated temperatures, comprising including in said hydrocarbon process stream an antifouling amount of a salt of a hydrocarbyl-substituted linked hydroxyaromatic compound, said linked compound comprising at least two aromatic moieties.

DETAILED DESCRIPTION OF THE INVENTION

The principal component of the present invention is a salt of a hydrcarbyl-substituted linked hydroxyaromatic compound. Hydrocarbyl-substituted aromatic compounds, also referred to as hydrocarbyl-substituted phenols are known materials, as is their method of preparation. When the term "phenol" is used herein, it is to be understood that this term is not generally intended to limit the aromatic group of the phenol to benzene (unless the context so indicates, for instance, in the Examples), although benzene may be the preferred aromatic group. Rather, the term is to be understood in its broader sense to include hydroxy aromatic compounds in general, for example, substituted phenols, hydroxy naphthalenes, and the like. Thus, the aromatic group of a "phenol" can be mononuclear or polynuclear, substituted, and can include other types of aromatic groups as well.

The aromatic group of the hydroxyaromatic compound can thus be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein pairs of aromatic nuclei making up the aromatic group share two points, such as found in naphthalene, anthracene, the azanaphthalenes, etc. Polynuclear aromatic moieties also can be of the linked type wherein at least two nuclei (either mono or polynuclear) are linked through bridging linkages to each other. Such bridging linkages can be chosen from the group consisting of carbon-to-carbon single bonds between aromatic nuclei, ether linkages, keto linkages, sulfide linkages, polysulfide linkages of 2 to 6 sulfur atoms, sulfinyl linkages, sulfonyl linkages, methylene linkages, alkylene linkages, di-(lower alkyl) methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in the aromatic group between aromatic nuclei. For example, a fluorene nucleus has two benzene nuclei linked by both a methylene linkage and a covalent bond. Such a nucleus may be considered to have 3 nuclei but only two of them are aromatic. Normally, the aromatic group will contain only carbon atoms in the aromatic nuclei per se, although other non-aromatic substitution, such as in particular short chain alkyl substitution can also be present. Thus methyl, ethyl, propyl, and t-butyl groups, for instance, can be present on the aromatic groups, even though such groups may not be explicitly represented in structures set forth herein.

Specific examples of single ring aromatic moieties are the following:

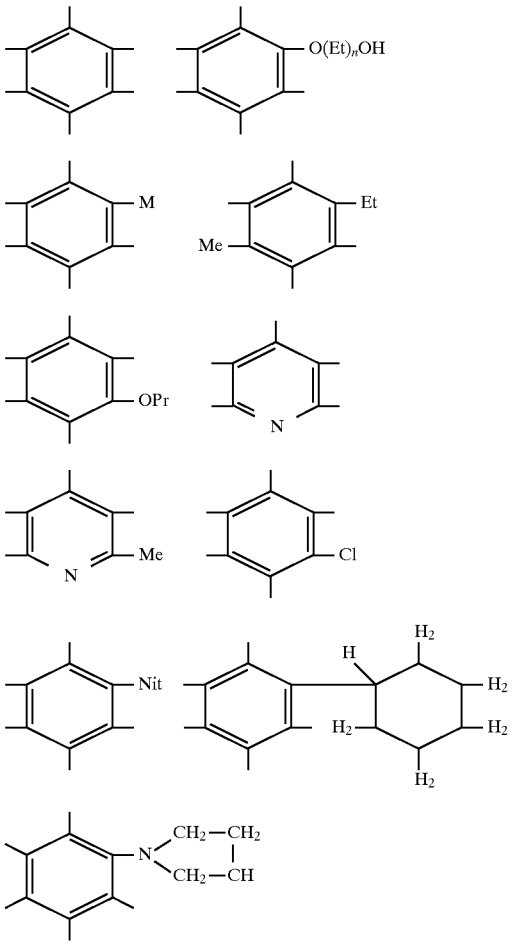

etc., wherein Me is methyl, Et is ethyl or ethylene, as appropriate, Pr is n-propyl, and Nit is nitro.

Specific examples of fused ring aromatic moieties are:

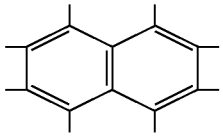

-continued

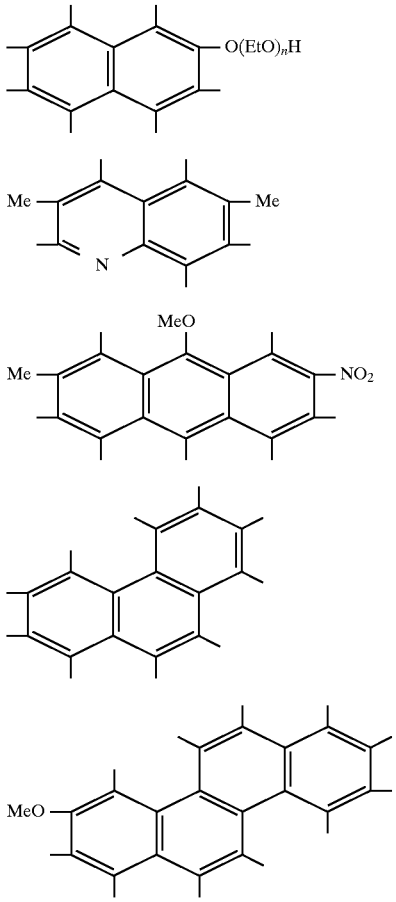

etc.

When the aromatic moiety is a linked polynuclear aromatic moiety, it can be represented by the general formula $$ar(—L—ar—)_w$$

wherein w is an integer of 1 to about 20, each ar is a single ring or a fused ring aromatic nucleus of 4 to about 12 carbon atoms and each L is independently selected from the group consisting of carbon-to-carbon single bonds between ar nuclei, ether linkages (e.g. —O—), keto linkages (e.g., —C(=O)—), sulfide linkages (e.g., —S—), polysulfide linkages of 2 to 6 sulfur atoms (e.g., $—S—_{2-6}$), sulfinyl linkages (e.g., —S(O)—), sulfonyl linkages (e.g., $—S(O)_2—$), lower alkylene linkages (e.g., $—CH_2—$, $—CH_2—CH_2—$, $—CH_2—CHR^o—$), mono(lower alkyl)-methylene linkages (e.g., $—CHR^o—$), di(lower alkyl)-methylene linkages (e.g.,$—CR^o{}_2—$), lower alkylene ether linkages (e.g., $—CH_2O—$, $—CH_2O—CH_2—$, $—CH_2—CH_2O—$, $—CH_2CH_2OCH_2CH—_2$, $—CH_2CHR^o—OCH_2CH—$, $—CHR^o—O—$, $—CHR^o—O—CHR^o—$, $—CH_2CHR^o—O—CHR^o—CH_2—$, etc.), lower alkylene sulfide linkages (e.g., wherein one or more —O—'s in the lower alkylene ether linkages is replaced with a S atom), lower alkylene polysulfide linkages (e.g., wherein one or more —O— is replaced with a $—S—_{2-6}$ group), amino linkages (e.g., —NH—, $—NR^o—$, $—CH_2N—$, $—CH_2NCH_2—$, —alk—N—, where alk is lower alkylene, etc.), polyamino linkages (e.g., $—N(alkN)_{1-10}$ where the unsatisfied free N valences are taken up with H atoms or $R^o$ groups), linkages derived from oxo-or keto-carboxylic acids (e.g.)

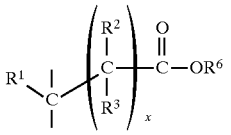

wherein each of $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each $R^o$ being a lower alkyl group).

Specific examples of linked moieties are:

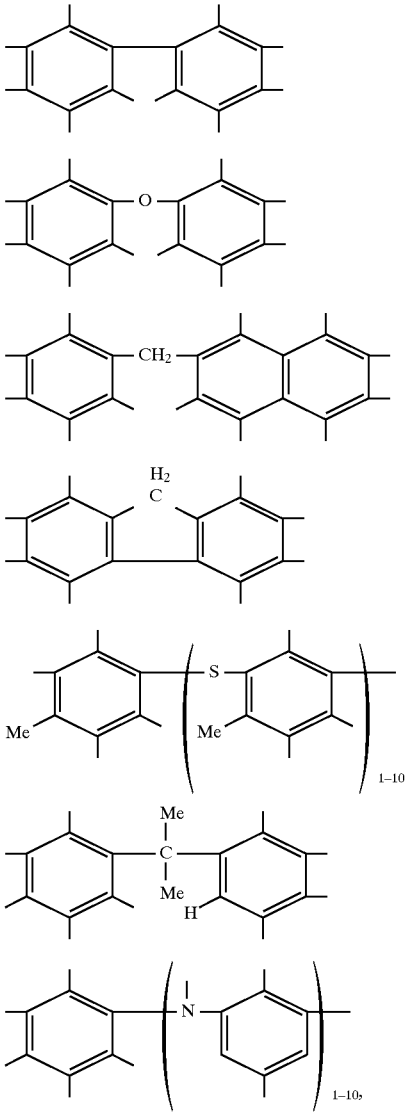

Usually all of these aromatic groups have no substituents except for those specifically named. For such reasons as cost, availability, performance, etc., the aromatic group is normally a benzene nucleus, a lower alkylene bridged benzene nucleus, or a naphthalene nucleus. Most preferably the aromatic group is a single benzene nucleus.

This primary component, being a salt of a hydrocarbyl-substituted linked hydroxyaromatic compound, can thus be a condensation product of a hydroxyaromatic compound, that is, a compound in which at least one hydroxy group is directly attached to an aromatic ring. The number of hydroxy groups per aromatic group will vary from I up to the maximum number of such groups that the hydrocarbyl-substituted aromatic moiety can accommodate while still retaining at least one, and preferably at least two, positions, at least some of which are preferably adjacent (ortho) to a hydroxy group, which are suitable for further reaction by condensation with a suitable material such as an aldehyde (described in detail below). Thus most of the molecules of the reactant hydroxyaromatic compound will have at least two unsubstituted positions. Suitable materials can include, then, hydrocarbyl-substituted catechols, resorcinols, hydroquinones, and even pyrogallols and phloroglucinols. Most commonly each aromatic nucleus, however, will bear one hydroxyl group and, in the preferred case when a hydrocarbyl substituted phenol is employed, the material will contain one benzene nucleus and one hydroxyl group. Of course, a small fraction of the aromatic reactant molecules may contain zero hydroxyl substituents. For instance, a minor amount of non-hydroxy materials may be present as an impurity. However, this does not defeat the spirit of the inventions, so long as the starting material is functional and contains, typically, at least one hydroxyl group per molecule.

The hydroxyaromatic reactant is similarly characterized in that it is hydrocarbyl substituted. The term "hydrocarbyl substituent" or "hydrocarbyl group" is used herein in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Preferably the hydrocarbyl group is an alkyl group. Typically the alkyl group will contain at least 6 carbon atoms, and preferably 7 to 1000 carbon atoms, more preferably 7 to 24 carbon atoms, and alternatively, preferably 18 to 50 carbon atoms. In another embodiment, the alkyl group is a polymeric group such as a polyethylene, a polypropylene, or a polybutene group, or another homo- or co-polyalkylene group. The alkyl substituents can be a mixture of alkyl groups of different chain lengths, as is indeed often the case with commercially available materials. The alkyl groups, in any case, can be derived from either linear or branched olefin reactants; linear are sometimes preferred, although the longer chain length materials tend to have increasing proportions of branching. A certain amount of branching appears to be introduced via a rearrangement mechanism during the alkylation process as well.

The hydrocarbyl group can be derived from the corresponding olefin; for example, a $C_{26}$ alkyl group is derived from a $C_{26}$ alkene, preferably a 1-alkene, a $C_{34}$ alkyl group is derived from a $C_{34}$ alkene, and mixed length groups are derived from the corresponding mixture of olefins. When the hydrocarbyl group is a hydrocarbyl group having at least about 30 carbon atoms, however, it is frequently an aliphatic group (or a mixture of such groups) made from homo- or interpolymers (e.g., copolymers, terpolymers) of mono-and di-olefins having 2 to 10 carbon atoms, such as ethylene, propylene, butene-1, isobutene, butadiene, isoprene, 1-hexene, and 1-octene. Aliphatic hydrocarbyl groups can also be derived from halogenated (e.g., chlorinated or brominated) analogs of such homo- or interpolymers. Such groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the hydrocarbyl groups can be reduced or eliminated, if desired, by hydrogenation according to procedures known in the art. Preparation by routes or using materials which are substantially free from chlorine or other halogens is sometimes preferred for environmental reasons.

More than one such hydrocarbyl group can be present, but usually no more than 2 or 3 are present for each aromatic nucleus in the aromatic group. Most typically only 1 hydrocarbyl group is present per aromatic moiety, particularly where the hydrocarbyl-substituted phenol is based on a single benzene ring.

The attachment of a hydrocarbyl group to the aromatic moiety of the first reactant of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y. Other equally appropriate and convenient techniques for attaching the hydrocarbon-based group to the aromatic moiety will occur readily to those skilled in the art.

The second component which reacts to form the antifouling compound of the present invention is a linking group or linking reagent. Typical linking agents include aldehydes or ketones or a reactive equivalent of aldehydes or ketones. These are well-known, commercially available materials, being represented by the formula $R_1$—C(=O)—$R_2$. In ketones, both $R_1$ and $R_2$ are hydrocarbyl groups; in aldehydes, at least 1 of $R_1$ and $R_2$ will be hydrogen; the other can be either hydrogen or hydrocarbyl. If the linking group is derived from a ketone, preferably at least one and preferably both of the R groups will be a lower alkyl group, having, for instance, 1 to 6 carbon atoms. If the linking group is an aldehyde, it will preferably be an aldehyde of 1 to 12 carbon atoms. Suitable aldehydes thus have the general formula RC(O)H, where R is preferably hydrogen or a hydrocarbyl group, as described above, although in all cases R can include other functional groups which do not interfere with the condensation reaction (described below) of the aldehyde with the hydroxyaromatic compound. This aldehyde preferably contains 1 to 12 carbon atoms, more preferably 1 to 4 carbon atoms, and still more preferably 1 or 2 carbon atoms. Such aldehydes include formaldehyde, acetaldehyde, propionaldehyde, butyraldehyde, isobutyraldehyde, pentanaldehyde, caproaldehyde, benzaldehyde, and higher aldehydes. Monoaldehydes are preferred. The most preferred aldehyde is formaldehyde, which can be supplied as a solution, but is more commonly used in the polymeric form, as paraformaldehyde. Paraformaldehyde may be considered a reactive equivalent of, or a source for, an aldehyde. Other reactive equivalents may include hydrates, alcoholates, or cyclic trimers of aldehydes. Reactive equivalents of ketones include the hydrates and alcoholates.

The hydrocarbyl phenol and the linking compound (e.g., aldehyde) are generally reacted in relative amounts ranging from molar or equivalent ratios of phenol:linking compound of 2:1 to 1:1.5. Preferably approximately equal molar amounts will be employed, up to a 30% molar excess of the linking compound (calculated based, for instance, on aldehyde monomer rather than oligomer or polymer). When an aldehyde is used as the linking compound, the amount of the aldehyde is preferably 5 to 20, more preferably 8 to 15, percent greater than the hydrocarbyl phenol on a molar basis. The components are reacted under conditions to lead to oligomer or polymer formation. The molecular weight of the product will depend on features including the equivalent ratios of the reactants, the temperature and time of the reaction, and the impurities present. The product can have from 2 to 100 aromatic units (i.e., the substituted aromatic phenol monomeric units) present ("repeating") in its chain, preferably 2 to 70 such units, more preferably 2 to 50, 30, or 14 units, and most preferably 2 to 12 units.

The hydrocarbyl phenol and the aldehyde are reacted by mixing the alkylphenol and the aldehyde in an appropriate amount of diluent oil or, optionally, another solvent such as an aromatic solvent, e.g., xylene, in the presence of an acid such as sulfuric acid, a sulfonic acid such as an alkylphenylsulfonic acid, para-toluene sulfonic acid, or methane sulfonic acid, an organic acid such as glyoxylic acid, or Amberlyst™ catalyst, a solid, macroporous, lightly crosslinked sulfonated polystyrene-divinylbenzene resin catalyst from Rohm and Haas. The mixture is heated, generally to 90° to 160° C., preferably 100° to 150° or to 120° C., for a suitable time, such as 30 minutes to 6 hours, preferably 1 to 4, hours, to remove water of condensation. The time and temperature are correlated so that reaction at a lower temperature will generally require a longer time, and so on. Determining the exact conditions is within the ability of the person skilled in the art. If desired, the reaction mixture can thereafter be heated to a higher temperature, e.g., 140°–180° C., preferably 145°–155° C., to further drive off volatiles and move the reaction to completion. The product can be treated with base such as NaOH if desired, in order to neutralize the strong acid catalyst and to prepare a sodium salt of the product, if desired, and is thereafter isolated by conventional techniques such as filtration, as appropriate.

The linked product will contain a linking group which, when prepared with an aldehyde or ketone, will contain an alkylene linking group. In the simplest case, when the linking agent is formaldehyde, the alkylene linking group will be a methylene group. If an alkyl-substituted aldehyde is used, e.g., RCHO, the linking group will generally be an alkyl-substituted methylene group, that is, a 1,1-alkylene group, —CHR—. If a ketone is used, RC(O)R', the linking group will be —CRR'—, although for steric reasons the formation of such linkages is less facile than those prepared from aldehydes, and particularly, formaldehyde.

The product of this reaction of hydrocarbyl substituted phenols with formaldehyde can be generally regarded as comprising polymers or oligomers having the following repeating structure:

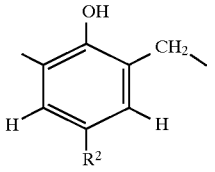

and positional isomers thereof. However, a portion of the formaldehyde which is preferably employed may be incorporated into the molecular structure in the form of substituent groups and linking groups such as those illustrated by the following types, including ether linkages and hydroxymethyl groups:

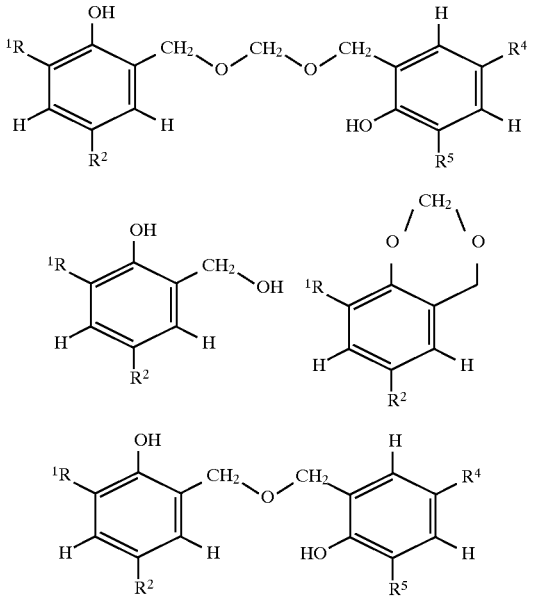

Alternatively, the hydrocarbyl-substituted aromatic moieties call be linked by a sulfur atom, or by a chain of up to about 4 sulfur atoms, preferably up to 2. Sulfur linkage can be provided by heating the hydrocarbyl phenol with a sulfurizing agent such as elemental sulfur or a reactive equivalent such as a sulfur halide such as $SCl_2$ or $S_2Cl_2$, at 50°–250° C., and usually, at least 160° C. if elemental sulfur is used, optionally in the presence of a suitable diluent. It is generally preferred to employ 0.5 to 2.5 moles of phenol per equivalent of sulfurizing agent. The equivalent weight of a sulfur halide is considered to be half its molecular weight, since one mole thereof reacts with two moles of phenol. The equivalent weight of sulfur is considered to be equal to its molecular weight since two atoms of sulfur react to provide one linkage and one molecule of $H_2S$. Particularly if a sulfur halide is used as the sulfurizing agent, it is frequently desirable to use an acid acceptor such as sodium hydroxide or sodium acetate to react with the hydrogen halide evolved. Reaction conditions when $SCl_2$ is the sulfurizing agent generally include heating to, e.g., 75°–110° C. for 2 to 3 hours. Preparation of sulfur-linked phenols is described in greater detail in U.S. Pat. No. 3,951,830, among others. When elemental sulfur is used as the linking agent, a variable amount of polysulfide bridging is sometimes obtained because of the oligomeric nature of the sulfur.

Finally, the aromatic moieties can be linked by a direct carbon-carbon bond between the rings.

In a preferred embodiment, the salt of the present invention is a salt of a compound principally represented by the structure

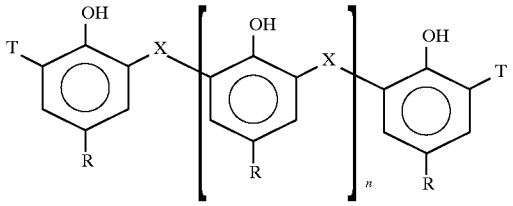

and positional isomers thereof. In this structure each R is independently a hydrocarbyl group as defined above, e.g., generally containing 6 to 1000 carbon atoms, each X is for the most part —$CH_2$— or a sulfur bridge, each T is selected from hydrogen, hydrocarbyl, hydroxymethyl, or formyl, and n is a number from 0 to 10.

The aforedescribed condensation product is supplied as a salt. The salt can be partially neutralized, fully neutralized, or overbased. Neutral salts are those in which all or substantially all of the acidic functionality is reacted with a basic material by conventional means to form the salt. Suitable cations include metals, ammonium, and amine ions, including quaternary ammonium ions. Suitable metals include alkali metals, alkaline earth metals, other monovalent and polyvalent metals such as aluminum and transition metals, and preferably divalent (doubly positively charged) metals such as magnesium, calcium, strontium, barium, tin, lead, iron (II), copper (II), and zinc, most preferably calcium or magnesium.

Partially neutralized salts of the present invention are those in which not all of the acidic group are reacted with the basic material. It is preferred that the acidic groups be at least 50 percent neutralized, preferably at least 70 percent, and more preferably at least substantially completely neutralized.

Overbased salts, sometimes referred to as superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (such as mineral oil, naphtha, toluene, xylene) for the acidic organic material, a stoichiometric excess of a metal base, and a promoter such as a phenol or alcohol. The acidic organic material in the present invention will be the phenolic product described in detail above; it should have a sufficient number of carbon atoms in its hydrocarbyl substituents to provide a degree of solubility in oil or the other organic solvent.

The amount of excess metal used in the preparation of the overbased material is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. For use in the present invention, the salts are not particularly limited as to metal ratio, although generally salts with a metal ratio of 0.5 (or even as low as 0.1) to 20 are suitable, and preferably with a metal ratio of 0.7 to 5, or 1.0 to 3.5, or 1.5 to 3.

Overbased materials generally and the processes for preparing them are well known to those skilled in the art.

Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. These techniques can be readily modified by those skilled in the art to prepare overbased phenolic compounds suitable for the present invention.

The detailed chemical and physical structures of the overbased and neutralized materials off the present invention are not precisely known. Thus it is not necessarily certain whether the phenolic OH groups are entirely neutralized, as opposed to existing as a complex mixture of the acid (phenolic) form with the basic material. Thus the terms "salt" and "overbased salt" and the like, as used herein, are explicitly intended to encompass these complex forms and any other as yet unidentified products which may be present, as well as the conventional salt forms.

Other Additives

The compositions employed in this invention may contain minor amounts of other components. The use of such components is optional and the presence thereof in the compositions of this invention will depend on the particular use and level of performance required. Thus these components may be included or excluded. Additives that may optionally be used include, for example, detergents; dispersants; oxidation inhibiting agents (which can function as chain termination agents which can inhibit undesired polymerization in petrochemical or hydrocarbon process streams), including phenylenediamine compounds, phenolics such as ortho-tertbutyl-para-methoxyphenol, quinones such as tertiary-butylcatechol, and sulfur/amine containing materials such as dialkyldithio-carbamates; corrosion inhibitors, such as substituted amines, e.g., tetrahydropyrimidene compounds, reaction products of alkylene polyamines with aliphatic carboxylic acids and optionally a lower aldehyde, alkaline earth metal salts of oil-soluble alkylbenzenesulfonic acids, amine salts of oil-soluble alkylnaphthalenesulfonic acids, dimercaptothiadiazoles, alkoxylated derivatives of alkyl phenols, reaction products of tallowamines and methylacrylate or acrylic acid, or the reaction product of fatty acids and polyamines; metal passivating agents (i.e., metal deactivators for such metals as copper or iron) such as N,N'-disalicylidene-1,2-cyclohcxanediamine, sodium N,N'-ethylenebis(2,5-sodium sulfocarolate)glycinate, dimercaptothiadiazolc derivatives, and reaction products of an alkylphenol, an aldehyde, and a polyamine. A more extensive list of oxidation inhibiting agents, corrosion inhibitors, and metal deactivators is found in U.S. Pat. No. 4,927,519. Zinc salts of dithiophosphoric acids, also referred to as zinc dithiophosphates, may also be present, although they are often omitted due to their perceived contribution to fouling. Pour point depressing agents, extreme pressure agents, viscosity improvers, and anti-wear agents may be present if desired, although such are not normally present in antifoulant compositions.

Additive Concentrates

The various additives described herein, including the salt of the linked hydrocarbyl-substituted hydroxyaromatic material, can be added directly to the hydrocarbon process streams. Alternatively, however, they can be diluted with a substantially inert, normally liquid organic diluent such as mineral oil, naphtha, benzene, toluene or xylene, to form an additive concentrate. These concentrates usually comprise 0.1 to 80% by weight, frequently from 1% to 10% by weight, more often from 10% to 80% by weight, of the compositions of this invention and may contain, in addition, one or more other additives known in the art or described hereinabove. Concentrations such as 15%, 20%, 30% or 50% or higher may be employed. Additive concentrates are prepared by mixing together, often at elevated temperature, the desired components.

The Hydrocarbon Process Streams

The above-described composition is used as an antifoulant for controlling the formation of fouling deposits in a hydrocarbon process stream during processing thereof at elevated temperatures. Such hydrocarbon streams include petroleum oils including crude oils, fractions of crude oil, such as naphtha, kerosene, jet fuel, diesel fuel, residual oil, vacuum gas oil, or vacuum residual oils (Bunker C fuel), and other feed stocks which are heavy in nature, such as atmospheric pipestill residuum, catalytic cracker residuum, and vacuum distillation residuum. Also included are naturally sourced and partially refined oils, including partially processed petroleum derived oils. Also included are alkane processes streams such as those wherein ethylene and propylene are obtained. Also included are olefininc or naphthenic process streams, aromatic hydrocarbons and their derivatives, ethylene dichloride, and ethylene glycol. Among the important units of, for example, an oil refinery where the use of the antifoulant of the present invention can be employed are crude unit preheat exchanger, crude unit vacuum resid exchanger, crude unit vacuum distillation heater and resid, fluid catalytic cracker preheat, fluid catalytic cracker slurry pumparound, delayed coker preheater and furnace, fluid coker, visbreaker, hydrotreater, hydrocracker, reboilers, hydrodesulfurizers, heat exchangers, hot separators, pumparound circuits, and process stream tubes.

The processing of such streams is often conducted at a temperature of 40° C. to 820° C., preferably 260° C. to 580° C. It is noted that the upper limits of the temperatures reported here and elsewhere in this specification and in the claims do not necessarily indicate the temperature of the bulk of the material in the process stream. Rather, they represent the contact temperature of the process stream at a metal surface, where fouling typically occurs.

The compositions of the present invention are employed in minor amounts in the hydrocarbon process streams in the present invention, often amounts ranging from 1 to 5000 parts per million, preferably 3 to 1000 parts per million, and more preferably 10 to 500 parts per million, e.g., 50–100 parts per million. The compositions can be added to hydrocarbon process streams by mixing, addition, metering, or other conventional means.

EXAMPLES

Materials used in the examples are as follows:

Example A

Methylene-coupled dodecylphenol, partially neutralized with calcium, having a metal ratio 0.85, prepared in a concentration of about 50.3% active chemical in diluent oil and having a total base number (to bromophenol endpoint, "TBN") of 90 (in diluent oil), prepared by a process more fully described in U.S. Pat. No. 3,256,183.

Example B

Methylene-coupled heptylphenol, partially neutralized with calcium, having a metal ratio 0.80, prepared in a concentration of about 32.5% active chemical in diluent oil and having and a TBN of 65 (in diluent oil), prepared as in Example A.

Example C

Sulfur-coupled dodecylphenol, overbased with magnesium, having a metal ratio of 2.30, prepared as about 59% active chemical in diluent oil, containing 2.5% sulfur and having a TBN of 90 (both measured in diluent oil), prepared by a process more fully described in U.S. Pat. No. 3,372,116 and 3,410,798.

Example D

Sulfur-coupled dodecylphenol, overbased with calcium, having a metal ratio of 1.10, prepared as about 45.7 percent active chemical in diluent oil, containing 3.2% sulfur and having a TBN of 90 (both measured in diluent oil), prepared generally as in Example C.

Example E.

Sulfur-coupled dodecylphenol, overbased with calcium, having a metal ratio of 1.10, prepared as about 50.2% active chemical in diluent oil, containing 3.7% sulfur and having a TBN of 90 (both measured in diluent oil), prepared generally as in Example C.

Example F

Sulfur-coupled dodecylphenol, overbased with calcium, having a metal ratio of 3.50, prepared as about 56.6% active chemical in diluent oil, containing 3.2% sulfur and having a TBN of 255 (both measured in diluent oil), prepared generally as in Example C.

Example G

Sulfur-coupled dodecylphenol, overbased with calcium, having a metal ratio of 2.30, prepared as about 62.2% active chemical in diluent oil, containing 2.6% sulfur and having a TBN of 200 (both measured in diluent oil), prepared generally as in Example C.

Example H

An overbased phenate similar to that of Example F, available commerciallly from Chevron/Oronite.

Samples of the foregoing materials are tested in a Hot Liquid Process Simulator manufactured by Alcor Petroleum Instruments, Inc., of San Antonio, Tex. Each additive is diluted with a heavy aromatic naphtha to approximately 25% active chemical and added to various feedstocks at the dosage indicated below, reported as part per million active chemical. During testing, a heater tube is maintained at a constant temperature, and a flow of fluid from a Parr bomb (under nitrogen pressure of 4.5–5.5 MPa [650–800 psig]) is maintained around the tube. As fouling deposits accumulate, heat transfer efficiency from the heater tube to the fluid decreases and temperature of the fluid at the outlet correspondingly decreases. The extent of fouling of the tube is measured by the increase in fluid outlet temperature of a sample under investigation as compared to the decrease caused by the untreated feed stock. In a given test, before significant fouling deposits accumulate, the "fluid out" temperature achieves a maximum temperature, $T_{max}$, which is used as a reference. The fluid out temperature decreases as fouling deposits accumulate on the heater tube. The temperature of the fluid out is plotted as a function of time, and the area of the plot above the actual temperature plot and below the $T_{max}$ line is designated the fouling area, FA. When no antifouling chemical is added, the area is referred to as $FA_{blank}$. The fouling area of a test sample which contains an antifoulant chemical is referred to as $FA_{chem}$. The percent protection provided by an antifoulant is calculated as $$\% \text{ Protection} = 100\% \times (FA_{blank} - FA_{chem}) \div FA_{blank}$$

Experimental details and results are shown in the following table:

| Ex | Feed | Additive[a] | ppm (active) | Rod Temp. °C. | Feed flow mL/min | Test duration hr | Baseline Δ area; (σ, %) | % Protection |
|---|---|---|---|---|---|---|---|---|
| R1 | Atmospheric residua from Gulf Coast refinery | — | 0 | 560 | 3 | 3 | 2048 (12) | — |
| 1 | Atmospheric residua from Gulf Coast refinery | A | 250 | " | " | " | " | 50 |
| 2 | Atmospheric residua from Gulf Coast refinery | B | 250 | " | " | " | " | 58 |
| 3 | Atmospheric residua from Gulf Coast refinery | C | 250 | " | " | " | " | 35 |
| 4 | Atmospheric residua from Gulf Coast refinery | D | 250 | " | " | " | " | 27 |
| 5 | Atmospheric residua from Gulf Coast refinery | E | 250 | " | " | " | " | 40 |
| R2 | Atmospheric residua from Gulf Coast refinery | — | 0 | 550 | 4 | 3 | 999 (19) | — |
| 6 | Atmospheric residua from Gulf Coast refinery | A | 125 | " | " | " | " | 24 |
| 7 | Atmospheric residua from Gulf Coast refinery | B | 250 | " | " | " | " | −3 |
| 8 | Atmospheric residua from Gulf Coast refinery | B | 125 | " | " | " | " | 73 |
| 9 | Atmospheric residua from Gulf Coast refinery | C | 125 | " | " | " | " | 38 |
| 10 | Atmospheric residua from Gulf Coast refinery | D | 125 | " | " | " | " | 17 |
| 11 | Atmospheric residua from Gulf Coast refinery | E | 125 | " | " | " | " | 23 |
| 12 | Atmospheric residua from Gulf Coast refinery | F | 125 | " | " | " | " | 23 |
| 13 | Atmospheric residua from Gulf Coast refinery | G | 125 | " | " | " | " | 41 |
| 14 | Atmospheric residua from Gulf Coast refinery | H | 125 | " | " | " | " | 55 |
| 15 | Atmospheric residua from Gulf Coast refinery | B | 125 | " | " | " | " | 17 |
| 16 | Atmospheric residua from Gulf Coast refinery | G | 125 | " | " | " | " | 24 |
| 17 | Atmospheric residua from Gulf Coast refinery | B + G | 100 +50 | " | " | " | " | 21 |
| 18 | Atmospheric residua | B + G | 250 | " | " | " | " | 23 |

-continued

| Ex | Feed | Additive[a] | ppm (active) | Rod Temp. °C. | Feed flow mL/min | Test duration hr | Baseline Δ area; (σ, %) | % Protection |
|---|---|---|---|---|---|---|---|---|
| | from Gulf Coast refinery | | +250 | | | | | |
| 19 | Atmospheric residua from Gulf Coast refinery | B + G | 500 +500 | " | " | " | " | 17 |
| R3 | Atmospheric residua from Gulf Coast refinery | — | 0 | 550 | 4 | 5 | 2463 (30) | — |
| 20 | Atmospheric residua from Gulf Coast refinery | A | 250 | " | " | " | " | 81 |
| 21 | Atmospheric residua from Gulf Coast refinery | B | 250 | " | " | " | " | 73 |
| 22 | Atmospheric residua from Gulf Coast refinery | G | 250 | " | " | " | " | 78 |
| 23 | Atmospheric residua from Gulf Coast refinery | A | 250 | " | " | " | " | 68 |
| 24 | Atmospheric residua from Gulf Coast refinery | A | 250 | " | " | " | " | 52 |
| 25 | Atmospheric residua from Gulf Coast refinery | G | 250 | " | " | " | " | 67 |
| R4 | vis-breaker feed from European refinery (1995) | — | 0 | 560 | 3 | 4 | 1815 (13) | — |
| 26 | vis-breaker feed from European refinery (1995) | B | 756 | " | " | " | " | 28 avg |
| 27 | vis-breaker feed from European refinery (1995) | D | 458 | " | " | " | " | 9 |
| 28 | vis-breaker feed from European refinery (1995) | D | 916 | " | " | " | " | 36 avg |
| R5 | same (1996) | — | 0 | 560 | 3 | 4 | 1903 (32) | — |
| 29 | " | B | 190 | " | " | " | " | 59 avg |
| 30 | " | B | 380 | " | " | " | " | 48 |
| 31 | " | B | 760 | " | " | " | " | 72 |
| 32 | " | A | 250 | " | " | " | " | 52 |
| R6 | vis-broken tar from European refinery (1995) | — | 0 | 540 | 3 | 4 | 3265 (26) | — |
| 33 | vis-broken tar from European refinery (1995) | B | 756 | " | " | " | " | 31 |
| 34 | vis-broken tar from European refinery (1995) | D | 916 | " | " | " | " | 5 |
| R7 | same (1996) | — | 0 | 560 | 3 | 3 | 3694 (31) | — |
| 35 | " | B | 95 | " | " | " | " | 33 |
| 36 | " | B | 125 | " | " | " | " | 49 |
| 37 | " | B | 190 | " | " | " | " | 46 |
| 38 | " | B | 250 | " | " | " | " | 40 |
| 39 | " | A | 250 | " | " | " | " | 32 |
| 40 | " | D | 125 | " | " | " | " | 26 |
| 41 | " | D | 250 | " | " | " | " | 39 avg |
| R8 | " | — | 0 | 540 | 4 | 3 | 4225 (22) | — |
| 42 | " | C | 250 | " | " | " | " | 45 |
| 43 | " | E | 250 | " | " | " | " | 72 |
| R9 | Mixture of atmospheric and vacuum residua from different Gulf Coast refinery | — | 0 | 570 | 2.5 | 3 | 1174 (12) | — |
| 44 | Mixture of atmospheric and vacuum residua from different Gulf Coast refinery | C | 250 | " | " | " | " | −14 |
| 45 | Mixture of atmospheric and vacuum residua from different Gulf Coast refinery | D | 500 | " | " | " | " | −16 |
| 46 | Mixture of atmospheric and vacuum residua from different Gulf Coast refinery | H | 500 | " | " | " | " | 14 |
| 47 | Mixture of atmospheric and vacuum residua from different Gulf Coast refinery | B | 250 | " | " | " | " | 19 |
| 48 | Mixture of atmospheric and vacuum residua from different Gulf Coast refinery | B | 500 | " | " | " | " | 13 |
| 49 | Mixture of atmospheric and vacuum residua from different Gulf Coast refinery | E | 250 | " | " | " | " | 16 |
| 50 | Mixture of atmospheric and vacuum residua from different Gulf Coast refinery | G | 500 | " | " | " | " | 53 avg |
| R10 | Mixture of atmospheric and vacuum residua from different Gulf Coast refinery | — | 0 | 580 | 2.5 | 3 | 2185 | — |
| 51 | Mixture of atmospheric and vacuum residua from | B | 125 | " | " | " | " | −6 |

-continued

| Ex | Feed | Additive[a] | ppm (active) | Rod Temp. °C. | Feed flow mL/min | Test duration hr | Baseline Δ area; (σ, %) | % Protection |
|---|---|---|---|---|---|---|---|---|
| | different Gulf Coast refinery | | | | | | | |
| 52 | Mixture of atmospheric and vacuum residua from different Gulf Coast refinery | B | 250 | " | " | " | " | −11 |
| R11 | Mixture of atmospheric and vacuum residua from different Gulf Coast refinery | — | 0 | 570 | 2.5 | 3 | 1532 (37) | — |
| 53 | Mixture of atmospheric and vacuum residua from different Gulf Coast refinery | A | 250 | " | " | " | " | 40 |
| 54 | Mixture of atmospheric and vacuum residua from different Gulf Coast refinery | G | 250 | " | " | " | " | 53 |
| 55 | Mixture of atmospheric and vacuum residua from different Gulf Coast refinery | B + G | 167 +83 | " | " | " | " | 14 |
| R12 | Mixture of atmospheric and vacuum residua from different Gulf Coast refinery | — | 0 | 570 | 2.5 | 3 | 1494 (19) | — |
| 56 | Mixture of atmospheric and vacuum residua from different Gulf Coast refinery | A | 250 | " | " | " | " | −14 |
| 57 | Mixture of atmospheric and vacuum residua from different Gulf Coast refinery | B | 250 | " | " | " | " | 0 |
| 58 | Mixture of atmospheric and vacuum residua from different Gulf Coast refinery | G | 250 | " | " | " | " | 4 |
| 59 | Mixture of atmospheric and vacuum residua from different Gulf Coast refinery | A + G | 125 +125 | " | " | " | " | 11 |
| 60 | Mixture of atmospheric and vacuum residua from different Gulf Coast refinery | B + G | 167 +83 | " | " | " | " | 28 |
| R13 | Same, from refinery of Ex. 1 | — | 0 | 575 | 3 | 3 | 2186 | — |
| 61 | Same, from refinery of Ex. 1 | A | 250 | " | " | " | " | 17 |
| 62 | Same, from refinery of Ex. 1 | B | 250 | " | " | " | " | 18 |
| 63 | Same, from refinery of Ex. 1 | G | 250 | " | " | " | " | 5 |
| R14 | Same, from refinery of Ex. 1 | — | 0 | 560 | 4 | 3 | 909 (27) | — |
| 64 | Same, from refinery of Ex. 1 | A | 500 | " | " | " | " | −2 |
| 65 | Same, from refinery of Ex. 1 | G | 500 | " | " | " | " | 9 |
| R15 | Same, from refinery of Ex. 1 | — | 0 | 570 | 3 | 3 | 1796 (13) | — |
| 66 | Same, from refinery of Ex. 1 | B | 500 | " | " | " | " | 11 |
| 67 | Same, from refinery of Ex. 1 | B | 1000 | " | " | " | " | 25 |
| 68 | Same, from refinery of Ex. 1 | B | 1250 | " | " | " | " | 36 avg |
| 69 | Same, from refinery of Ex. 1 | G | 625 | " | " | " | " | 32 |
| 70 | Same, from refinery of | G | 1250 | " | " | " | " | 41 |
| | Ex. 1 | D | 1250 | " | " | " | " | 41 |
| 72 | Same, from refinery of Ex. 1 | B + D | 625 +625 | " | " | " | " | −2 |
| 73 | Same, from refinery of Ex. 1 | B + G | 600 +300 | " | " | " | " | 39 |
| 74 | Same, from refinery of Ex. 1 | B + G | 800 +400 | " | " | " | " | 54 avg |
| 75 | Same, from refinery of Ex. 1 | B + G | 1000 +500 | " | " | " | " | 40 |
| 76 | Same, from refinery of Ex. 1 | B + G | 375+ 750 | " | " | " | " | 43 |
| 77 | Same, from refinery of Ex. 1 | B + G | 600 +900 | " | " | " | " | 31 |

[a]From the synthetic example A–H as indicated avg: average of multiple runs

σ: standard deviation of baseline measurements (where multiple baselines were run)

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A method for controlling the formation of fouling deposits in a hydrocarbon process stream during processing thereof at elevated temperatures, comprising including in said hydrocarbon process stream an antifouling amount of a salt of a hydrocarbyl-substituted linked hydroxyaromatic compound, said linked compound comprising at least two aromatic moieties, and the linkage between said aromatic moieties being a hydrocarbylene bridging group.

2. The process of claim 1 wherein the hydrocarbon process stream is a crude oil or a fraction of a crude oil.

3. The process of claim 2 wherein the hydrocarbon process stream is a residual oil, a vacuum gas oil, a vacuum residual oil, an atmospheric pipestill residuum, or a catalytic cracker residuum.

4. The process of claim 1 wherein the hydrocarbon process stream is an olefin pyrolysis stream or a purification process stream in an olefin processing operation.

5. The process of claim 1 wherein the hydrocarbon process stream is an ethylene process stream or a propylene process stream.

6. The process of claim 1 wherein the processing is conducted at a temperature of about 40° C. to about 820° C.

7. The process of claim I wherein the processing is conducted at a temperature of about 260° C. to about 580° C.

8. The process of claim 1 wherein the antifouling amount of said salt is about 1 to about 5,000 parts per million by weight of the process stream.

9. The process of claim 8 wherein the antifouling amount of said salt is about 3 to about 1000 parts per million by weight of the process stream.

10. The process of claim 9 wherein the antifouling amount of said salt is about 10 to about 500 parts per million by weight of the process stream.

11. The process of claim 1 wherein said salt is a neutral or overbased salt.

12. The process of claim 1 wherein said salt is a salt of a divalent metal.

13. The process of claim 12 wherein the salt is a calcium or magnesium salt.

14. The process of claim 1 wherein the aromatic moieties of the salt are bridged by an alkylene group.

15. The process of claim 14 wherein the alkylene group is a methylene group.

16. The process of claim 1 wherein the aromatic moieties of the salt are bridged by a group derived from the reaction of an aldehyde or a ketone or a reactive equivalent of an aldehyde or ketone.

17. The process of claim 16 wherein the aldehyde or ketone is formaldehyde or a reactive equivalent thereof.

18. The process of claim 1 wherein the aromatic moieties of the salt comprise benzene rings or naphthalene rings.

19. The process of claim 18 wherein the aromatic moieties are benzene rings.

20. The process of claim 1 wherein the linked hydroxyaromatic compound contains at least one hydrocarbyl substituent which is an alkyl group.

21. The process of claim 20 wherein the alkyl group contains at least 6 carbon atoms.

22. The process of claim 20 wherein the alkyl group contains 7 to about 1000 carbon atoms.

23. The process of claim 20 wherein the alkyl group contains 7 to about 24 carbon atoms.

24. The process of claim 20 wherein the alkyl group contains about 18 to about 50 carbon atoms.

25. The process of claim 20 wherein the alkyl group is a polybutene group.

26. The process of claim 1 wherein the number of linked aromatic groups in the salt is 2 to about 12.

27. The process of claim 1 wherein the salt is a salt of a compound represented by the structure

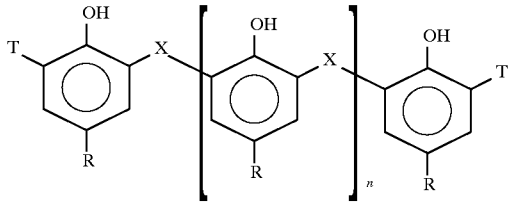

and positional isomers thereof;

where each R is independently a hydrocarbyl group containing 6 to about 1000 carbon atoms, each X is —$CH_2$—, each T is selected from hydrogen, hydrocarbyl, hydroxymethyl, or formyl, and n is a number from 0 to 10.

28. The process of claim 1 wherein the salt is added in the form of a concentrate comprising a diluent.

29. A composition comprising a hydrocarbon process stream and an antifouling amount of the salt of claim 1.

30. A method of controlling the formation of fouling deposits in a hydrocarbon process stream during processing thereof at elevated temperatures, comprising including in said hydrocarbon process stream an antifouling amount of a salt of a hydrocarbyl-substituted linked hydroxyaromatic compound, said linked compound comprising at least two aromatic groups, wherein the salt is a salt of a compound represented by the structure

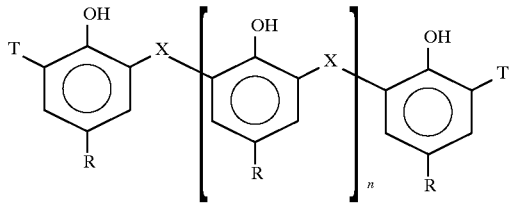

and positional isomers thereof, where each R is independently a hydrocarbyl group, each X is a sulfur bridge, each T is selected from hydrogen, hydrocarbyl, hydroxymethyl, or formyl, and n is 0 or a positive integer.

31. The method of claim 30 wherein the hydrocarbon process stream is a crude oil, a fraction of a crude oil, an olefin pyrolysis stream, or a purification process stream in an olefin processing operation.

32. The process of claim 30 wherein the processing is conducted at a temperature of 40° C. to 820° C.

33.The process of claim 30 wherein the antifouling amount of said salt is 1 to 5,000 parts per million by weight of the process stream.

34. The process of claim 30 wherein the salt is a calcium or magnesium salt.

35. The process of claim 30 wherein the linked hydroxyaromatic compound contains at least one hydrocarbyl substituent which is an alkyl group of at least 6 carbon atoms.

36. The process of claim 33 wherein the alkyl group is a polybutene group.

37. The process of claim 30 wherein the n is 0 to 10.

38. A composition comprising a hydrocarbon process stream and an antifouling amount of the salt of claim 30.

* * * * *